US007143587B2

(12) United States Patent
Acharya et al.

(10) Patent No.: US 7,143,587 B2
(45) Date of Patent: Dec. 5, 2006

(54) LOW FREQUENCY PULSE TUBE SYSTEM WITH OIL-FREE DRIVE

(75) Inventors: Arun Acharya, East Amherst, NY (US); Bayram Arman, Grand Island, NY (US); Richard C. Fitzgerald, Grand Island, NY (US); James J. Volk, Clarence, NY (US); John Henri Royal, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 329 days.

(21) Appl. No.: 10/796,112

(22) Filed: Mar. 10, 2004

(65) Prior Publication Data

US 2005/0198970 A1 Sep. 15, 2005

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 5,113,663 | A | 5/1992 | Gifford | 62/6 |
| 5,389,844 | A | 2/1995 | Yarr et al. | 310/15 |
| 5,398,512 | A | 3/1995 | Inaguchi et al. | 62/6 |
| 5,431,551 | A | 7/1995 | Aquino et al. | 418/61.2 |
| 5,487,272 | A | 1/1996 | Nagao | 62/6 |
| 5,901,737 | A * | 5/1999 | Yaron | 137/246.12 |
| 6,094,921 | A * | 8/2000 | Zhu et al. | 62/6 |
| 6,127,750 | A * | 10/2000 | Dadd | 310/13 |
| 6,138,459 | A | 10/2000 | Yatsuzuka et al. | 62/6 |
| 6,209,328 | B1 | 4/2001 | Kim et al. | 62/6 |
| 6,230,499 | B1 * | 5/2001 | Hohne | 62/6 |
| 6,374,617 | B1 | 4/2002 | Bonaquist et al. | 62/6 |
| 6,378,312 | B1 * | 4/2002 | Wang | 62/6 |
| 6,640,553 | B1 | 11/2003 | Kotsubo et al. | 62/6 |
| 6,644,038 | B1 | 11/2003 | Acharya et al. | 62/6 |
| 2002/0066276 | A1 * | 6/2002 | Kawano et al. | 62/6 |
| 2003/0089116 | A1 * | 5/2003 | Heron | 62/6 |
| 2004/0040315 | A1 * | 3/2004 | Koyama et al. | 62/6 |

* cited by examiner

*Primary Examiner*—William C. Doerrler
(74) *Attorney, Agent, or Firm*—David M. Rosenblum

(57) ABSTRACT

A pulse tube system for generating refrigeration for uses such as in magnetic resonance imaging systems wherein an oil-free compressor operating at a higher frequency generates pulsing gas which undergoes a frequency reduction and drives the pulse tube system at a more efficient lower frequency.

9 Claims, 2 Drawing Sheets

LOW FREQUENCY PULSE TUBE SYSTEM WITH OIL-FREE DRIVE

TECHNICAL FIELD

This invention relates generally to low temperature or cryogenic refrigeration and, more particularly, to pulse tube refrigeration.

BACKGROUND ART

A recent significant advancement in the field of generating low temperature refrigeration is the pulse tube system or cryocooler wherein pulse energy is converted to refrigeration using an oscillating gas. Such systems can generate refrigeration to very low levels sufficient, for example, to liquefy helium. One important application of the refrigeration generated by such cryocooler system is in magnetic resonance imaging systems.

One problem with conventional cryocooler systems is contamination of the pulsing gas by the pulse generating equipment. Moreover, a source of inefficiency is a mismatch between the most efficient operating frequency of the cryocooler system and the most efficient operating frequency of the pulse generating system.

Accordingly it is an object of this invention to provide an improved cryocooler or pulse tube system which has reduced contamination potential and more efficient operation.

SUMMARY OF THE INVENTION

The above and other objects, which will become apparent to those skilled in the art upon a reading of this disclosure, are attained by the present invention, one aspect of which is:

A method for operating a low frequency cryocooler system comprising:

(A) generating pulsing gas at a frequency of at least 25 hertz by compressing a gas using a moving element moving proximate a surrounding wall wherein no oil is employed between the moving element and the surrounding wall;

(B) passing the pulsing gas through a frequency modulation valve and reducing the frequency of the pulsing gas to produce lower frequency pulsing gas; and (C) passing the lower frequency pulsing gas to a regenerator which is in flow communication with a thermal buffer tube.

Another aspect of the invention is:

A low frequency cryocooler system comprising:

(A) a compressor having a discharge and having a moving element proximate a surrounding wall wherein no oil is employed between the moving element and the surrounding wall;

(B) a regenerator, a frequency modulation valve, discharge conduit extending from the discharge to the frequency modulation valve, and regenerator input/output conduit extending from the frequency modulation valve to the regenerator; and (C) a thermal buffer tube in flow communication with the regenerator.

As used herein the term "regenerator" means a thermal device in the form of porous distributed mass or media, such as spheres, stacked screens, perforated metal sheets and the like, with good thermal capacity to cool incoming warm gas and warm returning cold gas via direct heat transfer with the porous distributed mass.

As used herein the term "thermal buffer tube" means a cryocooler component separate from the regenerator and proximate the cold heat exchanger and spanning a temperature range from the coldest to the warmer heat rejection temperature for that stage.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

As used herein the term "frequency modulation valve" means a valve or system of valves generating oscillating pressure and mass flow at a desired frequency.

As used herein the term "discharge frequency modulating volume" means the total volume of the discharge conduit, and the reservoir if employed, extending from the compressor discharge to the frequency modulation valve. The discharge frequency modulating volume may be from 0.1 to 10 times the displacement volume of the compressor.

As used herein the term "suction frequency modulating volume" means the total volume of the suction conduit, and the reservoir if employed, extending from the frequency modulation valve to the compressor suction. The suction frequency modulation volume may be from 0.1 to 10 times the displacement volume of the compressor.

Figure 1:
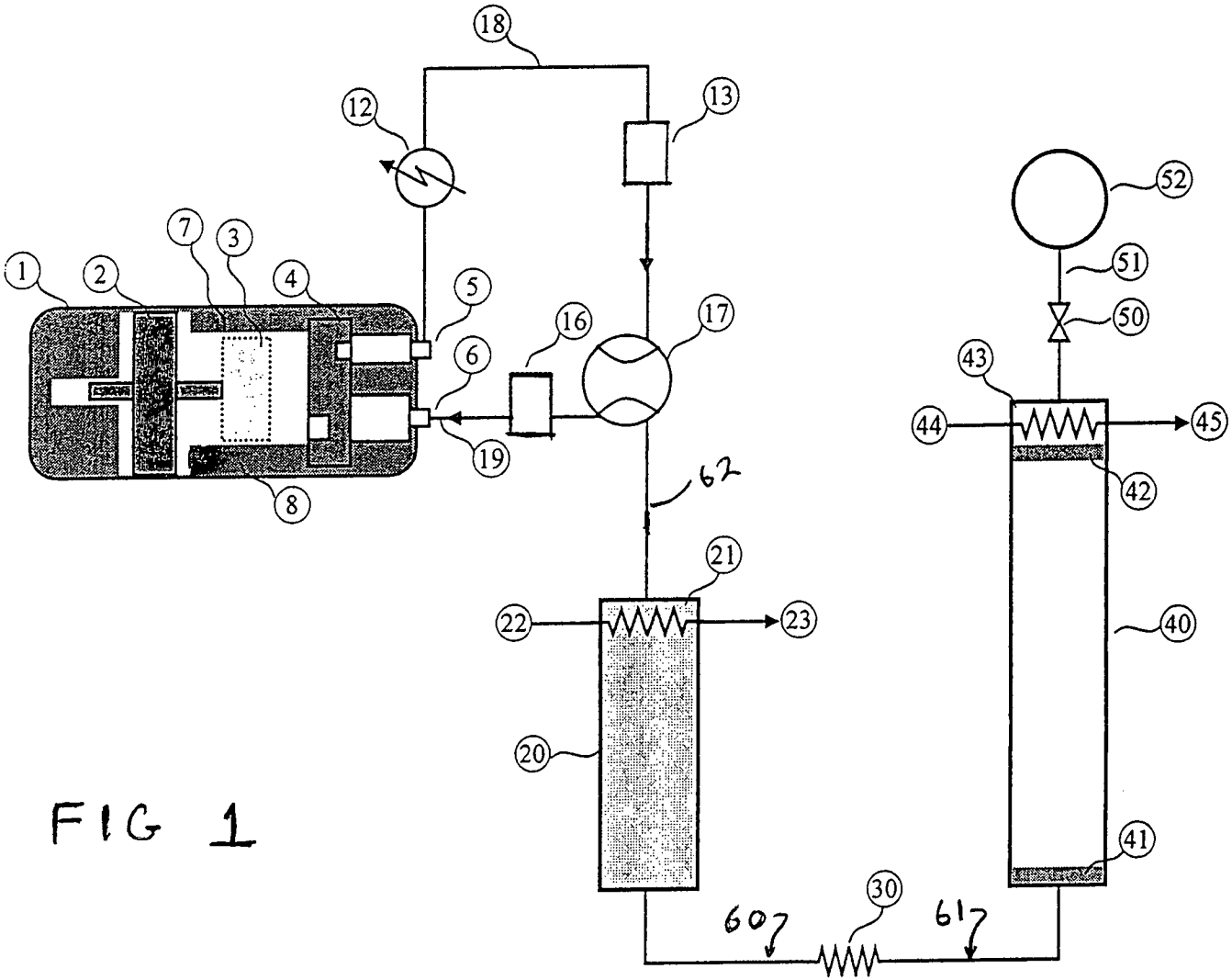
FIG. 1 is a schematic representation of one preferred embodiment of the invention wherein the compressor is a linear compressor and the frequency modulation valve is a rotary valve.

The numerals in the Drawings are the same for the common elements.

DETAILED DESCRIPTION

The invention will be described in detail with reference to the Drawings. Referring now to FIG. 1, an oil-free compressor generates a pulsing gas to drive the cryocooler or pulse tube system which comprises regenerator 20 and thermal buffer tube 40. Oil-free compressors operate efficiently at high frequencies, typically at from 50 to 60 hertz. In the embodiment of the invention illustrated in FIG. 1 the oil-free compressor is a linear compressor 1 driven by an electrically driven linear motor, i.e. axially reciprocating electromagnetic transducer 2. Another example of an oil-free compressor which may be used in the practice of this invention is an oil-free guided rotary compressor driven by a rotary motor.

The oil-free compressor has a moving element proximate a surrounding wall. In the embodiment of the invention illustrated in FIG. 1 the moving element is piston 3 which is driven back and forth by linear motor 2. Piston 3 reciprocates within the volume defined by casing or surrounding wall 8 and is proximate surrounding wall 8 separated therefrom by clearance 7. There is no oil in clearance 7 between piston 3 and surrounding wall 8. Instead, the linear compressor employs gas bearings or flexure suspensions to ensure facile motion of piston 3.

The reciprocating piston 3 generates gas having a pulsing or oscillating motion at the frequency of the alternating current power supplied of at least 25 hertz and typically about 50 to 60 hertz. Check valve system 4, usually termed reed valves, converts the oscillating pressure wave to obtain a compression output at compressor discharge 5 which has small fluctuations at its operating frequency. Examples of gas which may be used as the pulsing gas generated by the oil-free compressor in the practice of this invention include helium, neon, hydrogen, nitrogen, argon, oxygen, and mixtures thereof, with helium being preferred.

The pulsing gas is cooled of the heat of compression in cooler 12 and passed in discharge conduit 18 to frequency modulation valve 17 which, in the embodiment illustrated in FIG. 1, is a rotary valve. Rotary valve 17 is driven by a motorized system which is not shown in FIG. 1. Preferably, as shown in FIG. 1, the high frequency pulsing gas in discharge conduit 18 passes through reservoir 13. The discharge frequency modulating volume of discharge conduit 18 and reservoir 13 serves to decouple the pulse rate between the compressor and the crycooler by providing a steady gas supply at a relatively stable pressure to the valve. As the rotating part (not shown) of rotary valve 17 rotates, the bores alternatively connect the compressor discharge conduit 18 to the regenerator inlet/outlet conduit 62, and the regenerator inlet/outlet conduit 62 to the compressor suction conduit 19. These alternating connections generate oscillating pressure and mass flow thus a pressure-volume work at the rotation frequency of the valve 17.

As the pulsing gas passes through the frequency modulation valve its frequency is reduced to the most efficient operating frequency of the cryocooler. The resulting lower frequency pulsing gas generally has a frequency less than 40 hertz, typically has a frequency less than 30 hertz, preferably less than 10 hertz, most preferably less than 5 hertz. The lower frequency pulsing gas is then passed to regenerator 20 of the cryocooler or pulse tube system. Regenerator 20 is in flow communication with thermal buffer tube 40 of the pulse tube system.

The lower frequency pulsing gas applies a pulse to the hot end of regenerator 20 thereby generating an oscillating working gas and initiating the first part of the pulse tube sequence. The pulse serves to compress the working gas producing hot compressed working gas at the hot end of the regenerator 20. The hot working gas is cooled, preferably by indirect heat exchange with heat transfer fluid 22 in heat exchanger 21, to produce warmed heat transfer fluid in stream 23 and to cool the compressed working gas of the heat of compression. Examples of fluids useful as the heat transfer fluid 22, 23 in the practice of this invention include water, air, ethylene glycol and the like. Heat exchanger 21 is the heat sink for the heat pumped from the refrigeration load against the temperature gradient by the regenerator 20 as a result of the pressure-volume work generated by the compressor and the frequency modulation valve.

Regenerator 20 contains regenerator or heat transfer media. Examples of suitable heat transfer media in the practice of this invention include steel balls, wire mesh, high density honeycomb structures, expanded metals, lead balls, copper and its alloys, complexes of rare earth element(s) and transition metals. The pulsing or oscillating working gas is cooled in regenerator 20 by direct heat exchange with cold regenerator media to produce cold pulse tube working gas.

Thermal buffer tube 40 and regenerator 20 are in flow communication. The flow communication includes cold heat exchanger 30. The cold working gas passes in line 60 to cold heat exchanger 30 and in line 61 from cold heat exchanger 30 to the cold end of thermal buffer tube 40. Within cold heat exchanger 30 the cold working gas is warmed by indirect heat exchange with a refrigeration load thereby providing refrigeration to the refrigeration load. This heat exchange with the refrigeration load is not illustrated. One example of a refrigeration load is for use in a magnetic resonance imaging system. Another example of a refrigeration load is for use in high temperature superconductivity.

The working gas is passed from the regenerator 20 to thermal buffer tube 40 at the cold end. Preferably, as illustrated in FIG. 1 thermal buffer tube 40 has a flow straightener 41 at its cold end and a flow straightener 42 at its hot end. As the working gas passes into pulse thermal buffer 40 it compresses gas in the thermal buffer tube and forces some of the gas through heat exchanger 43 and orifice 50 in line 51 into the reservoir 52. Flow stops when pressures in both the thermal buffer tube and the reservoir are equalized.

Cooling fluid 44 is passed to heat exchanger 43 wherein it is warmed or vaporized by indirect heat exchange with the working gas, thus serving as a heat sink to cool the compressed working gas. Resulting warmed or vaporized cooling fluid is withdrawn from heat exchanger 43 in stream 45. Preferably cooling fluid 44 is water, air, ethylene glycol or the like.

In the low pressure point of the pulsing sequence, the working gas within the thermal buffer tube expands and thus cools, and the flow is reversed from the now relatively higher pressure reservoir 52 into the thermal buffer tube 40. The cold working gas is pushed into the cold heat exchanger 30 and back towards the warm end of the regenerator while providing refrigeration at heat exchanger 30 and cooling the regenerator heat transfer media for the next pulsing sequence. Orifice 50 and reservoir 52 are employed to maintain the pressure and flow waves in phase so that the thermal buffer tube generates net refrigeration during the compression and the expansion cycles in the cold end of thermal buffer tube 40. Other means for maintaining the pressure and flow waves in phase which may be used in the practice of this invention include inertance tube and orifice, expander, linear alternator, bellows arrangements, and a work recovery line connected back to the compressor with a mass flux suppressor. In the expansion sequence, the working gas expands to produce working gas at the cold end of the thermal buffer tube 40. The expanded gas reverses its direction such that it flows from the thermal buffer tube toward regenerator 20. The relatively higher pressure gas in the reservoir flows through valve 50 to the warm end of the thermal buffer tube 40. In summary, thermal buffer tube 40 rejects the remainder of pressure-volume work generated by the compression and frequency modulation system (which comprises the oil-free compressor and the frequency modulation valve) as heat into warm heat exchanger 43.

The expanded working gas emerging from heat exchanger 30 is passed in line 60 to regenerator 20 wherein it directly contacts the heat transfer media within the regenerator to produce the aforesaid cold heat transfer media, thereby completing the second part of the pulse tube refrigerant sequence and putting the regenerator into condition for the first part of a subsequent pulse tube refrigeration sequence. Pulsing gas from regenerator 20 passes back to rotary valve 17 and in suction conduit 19 to suction 6 of compressor 1. Preferably reservoir 16 is employed on suction conduit 19 and the suction frequency modulating volume of suction conduit 19 and reservoir 16 serves a purpose similar to that of the discharge frequency modulating volume.

Figure 2:
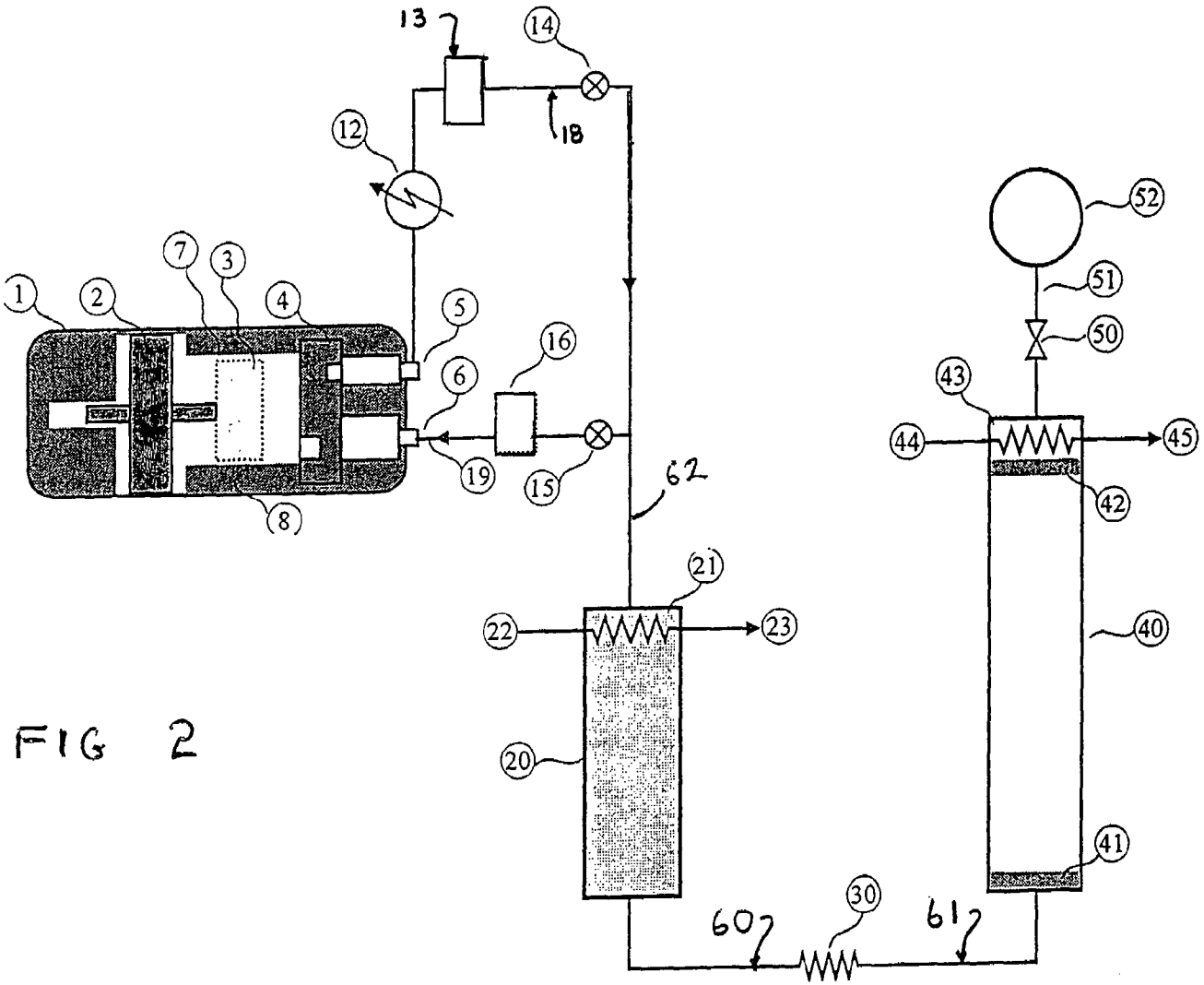
FIG. 2 is a schematic representation of another preferred embodiment of the invention wherein the compressor is a linear compressor and the frequency modulation valve is a control valve system.

FIG. 2 illustrates another embodiment of the invention. The elements common to the embodiments illustrated in FIGS. 1 and 2 will not be described again in detail. In the embodiment illustrated in FIG. 2 the rotary valve is replaced with dual control valves 14 and 15 on the output and input conduits respectively, with motor driven control valve 14 serving as the frequency modulation valve.

Now by the use of this invention a cryocooler, i.e. a pulse tube system, may operate at its most efficient frequency rather than being limited to operating at the frequency of the compressor while also avoiding complications caused by oil contamination of the pulsing gas. Although the invention has been described in detail with reference to certain preferred embodiments, those skilled in the art will recognize that there are other embodiments within the spirit and the scope of the claims.

The invention claimed is:

1. A method for operating a low frequency cryocooler system comprising:

generating pulsing gas at a frequency of at least 25 hertz by compressing a gas using a moving element moving proximate a surrounding wall wherein no oil is employed between the moving element and the surrounding wall;

passing the pulsing gas through a discharge frequency modulating volume;

passing the pulsing gas through a frequency modulation valve after having passed through the frequency modulating volume and reducing the frequency of the pulsing gas to produce lower frequency pulsing gas; and passing the lower frequency pulsing gas to a regenerator which is in flow communication with a thermal buffer tube.

2. The method of claim 1 wherein the moving element is a piston driven by an axially reciprocating electromagnetic transducer.

3. The method of claim 1 wherein the discharge frequency modulating volume includes a reservoir.

4. The method of claim 1 wherein the lower frequency pulsing gas has a frequency of less than 10 hertz.

5. A low frequency cryocooler system comprising:

a compressor having a discharge and having a moving element proximate a surrounding wall wherein no oil is employed between the moving element and the surrounding wall;

a regenerator, a frequency modulation valve, discharge conduit extending from the discharge to the frequency modulation valve, a reservoir positioned on the discharge conduit between the discharge and the frequency modulation valve to comprise a discharge frequency modulating volume and regenerator input/output conduit extending from the frequency modulation valve to the regenerator; and a thermal buffer tube in flow communication with the regenerator.

6. The low frequency pulse tube system of claim 5 wherein the compressor is a linear compressor and the moving element is a piston driven by an axially reciprocating electromagnetic transducer.

7. The low frequency pulse tube system of claim 5 wherein the frequency modulation valve is a rotary valve.

8. The low frequency pulse tube system of claim 7 further comprising suction conduit extending from the rotary valve to the compressor suction.

9. The low frequency pulse tube system of claim 8 further comprising a reservoir positioned on the suction conduit between the rotary valve and the compressor suction to comprise a suction frequency modulating volume.

* * * * *